United States Patent [19]

Reccius et al.

[11] Patent Number: 4,498,325

[45] Date of Patent: Feb. 12, 1985

[54] METHOD FOR SHAPING PANELS BY A BENDING OPERATION, IN PARTICULAR PANELS FOR AIRCRAFT FUSELAGE SKIN, AND APPARATUS FOR IMPLEMENTING SUCH METHOD

[75] Inventors: Helmut Reccius, Munich; Werner Pönitzsch, Friedrichshafen, both of Fed. Rep. of Germany

[73] Assignees: Walter Eckold GmbH & Co. KG, Andreasberg; Dornier GmbH, Friedrichshafen, both of Fed. Rep. of Germany

[21] Appl. No.: 426,472

[22] Filed: Sep. 29, 1982

[51] Int. Cl.[3] ..... B21D 11/20

[52] U.S. Cl. ..... 72/302; 72/379; 72/395

[58] Field of Search ..... 72/295, 301, 302, 303, 72/308, 379, 392, 395

[56] References Cited

U.S. PATENT DOCUMENTS

| | | | |
|---|---|---|---|
| 2,464,169 | 3/1949 | Bentley | 72/302 |
| 2,852,062 | 9/1958 | Lorant | 72/302 |
| 2,958,242 | 11/1960 | Marchant | 72/395 |
| 3,015,353 | 1/1962 | Brown | 72/302 |

*Primary Examiner*—Lowell A. Larson

*Attorney, Agent, or Firm*—C. Michael Zimmerman

[57] ABSTRACT

A method is disclosed for bending panels which are provided with reinforcing stiffening ribs. The bending is caused by upsetting or elongating the ribs. Apparatus for carrying out the method also is disclosed and includes means which engage the ribs at points spaced a predetermined distance from the panel skin. The invention is particularly applicable to the shaping of aircraft fuselage skin sections.

10 Claims, 8 Drawing Figures

Fig.1
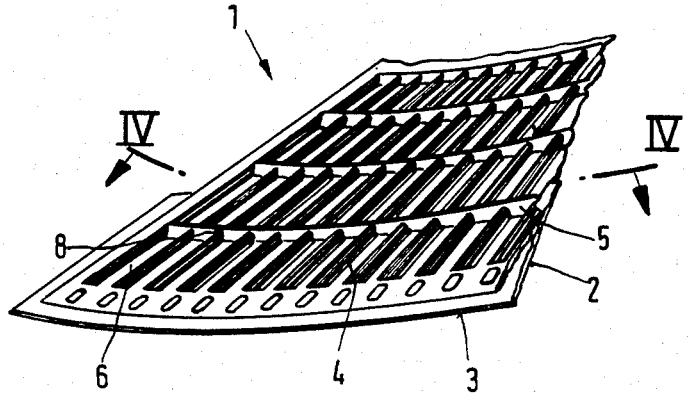
Fig. 4a
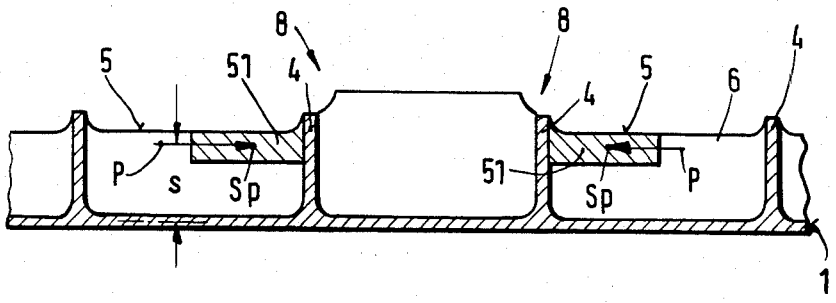
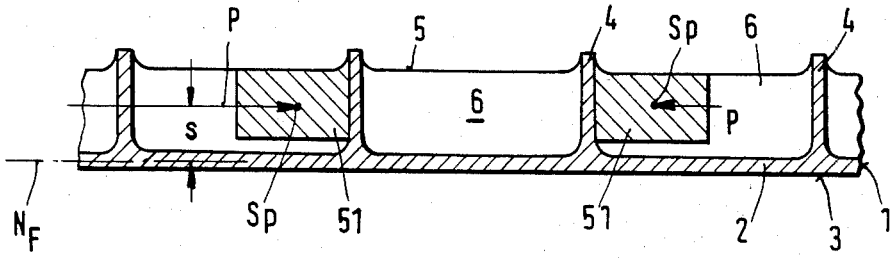
Fig. 4b
Fig. 5
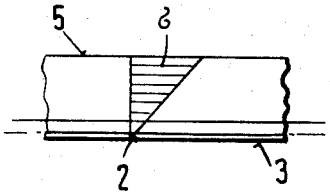

METHOD FOR SHAPING PANELS BY A BENDING OPERATION, IN PARTICULAR PANELS FOR AIRCRAFT FUSELAGE SKIN, AND APPARATUS FOR IMPLEMENTING SUCH METHOD

BACKGROUND OF THE INVENTION

The present invention relates to a method for shaping panels, in particular aircraft fuselage skin sections, by means of bending. Such panels consist of a material which is elastically and plastically deformable, and in case of aircraft fuselage skin sections, is preferably of aluminum.

Aircraft, whether military or civil, must meet extreme requirements. Nevertheless, their manufacture should not involve excessive cost. These somewhat contradictory criteria apply in particular to the manufacture of curved skin sections or panels used for the fuselage, the wings, and other parts of aircraft.

Recent developments in the design of aircraft has resulting in panels or skin sections having an outer skin portion and reinforcing ribs or so-called "stringers" as integrally formed members. By means of modern milling machines, panels having at each point calculated minimum dimensions of skin, ribs and, as the case may be, additional fins intersecting the ribs, may be manufactured of solid aluminum sheet material.

Considerable problems, however, exist in the shaping of such integral panels to a curvature provided in accordance with a given pattern; the combination of skin, ribs, and fins intersecting the ribs, renders these panels very stiff and resistant to deformation.

Several methods are known by which such panels may be shaped: Stretch-drawing, ball blasting, rolling, and whipping. However, these processes involve difficulties when applied to integral panels.

Stretch-drawing results in locally inappropriate deformations unless very expensive apparatus is provided. Ball blasting is suitable only if the skin thickness exceeds a predetermined minimum to allow for the necessary skin dilation. Rolling and whipping are subject to limitations as to the shapes which may be obtained; in particular, there are problems with non-cylindrical or spherically curved workpieces, and this is particularly true when the ribs and fins of the panel have different height dimensions.

SUMMARY OF THE INVENTION

The panel is bent in accordance with the invention by varying, parallel to the skin of the panel, the length of reinforcing ribs, either by upsetting or by stretching them. The ribs are engaged for transmittal of the necessary forces at predetermined points of their height, measured from the skin, such that preferably only bending torques will be developed in the skin so that the area dimensions of the skin will remain substantially unchanged.

An apparatus adapted to transmit the described forces to the reinforcing ribs of the panel briefly comprises two pairs of jaws engaging, at spaced-apart points, one of the ribs, and hydraulic means to move these jaw pairs relative to each other. The stroke of such relative movement is adjustable, as is the distance between the jaw pairs. Thus, the apparatus is very versatile; the jaw pair distance defines the length of the rib over which the adjusted stroke will be effective, and thus the relative upsetting or stretching. No particular precautions need be provided at the panel, and it is particularly advantageous that the apparatus may be designed so small and compact that it can be manually moved relative to the panel which, preferably, is disposed over a bending template.

BRIEF DESCRIPTION OF THE DRAWINGS

FIG. 1 illustrates isometrically an example of a panel to be brought to the shape shown by means of the method of the present invention, FIG. 5 is a diagram illustrating the strain distribution in the panel.

DESCRIPTION OF A PREFERRED EMBODIMENT

Figure 2:
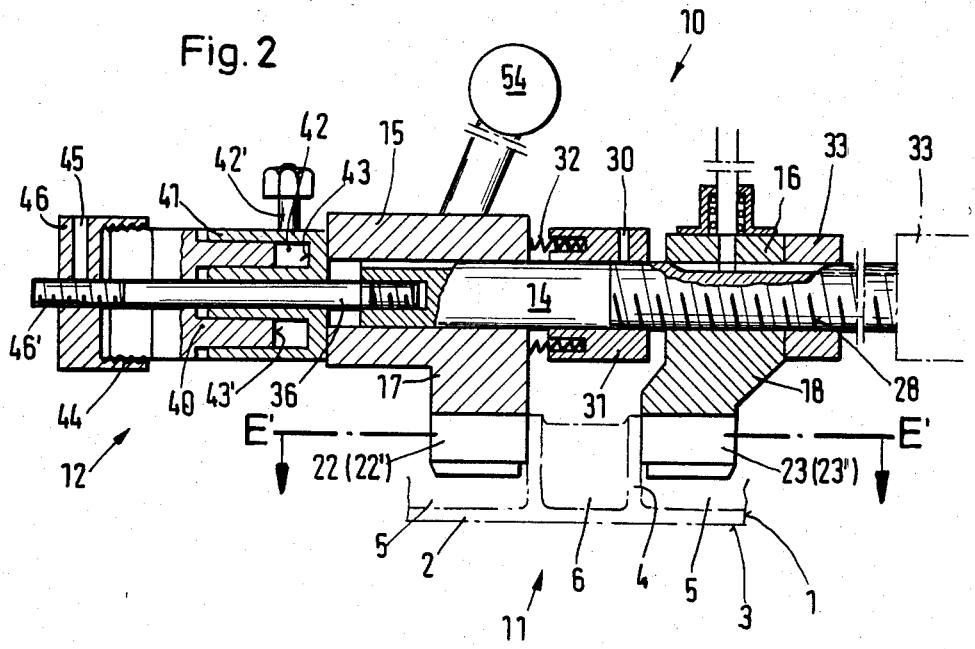
FIG. 2 is a schematized sectional view of a preferred embodiment of the apparatus of the invention.

FIG. 1 illustrates, as an example, a panel 1 shaped in accordance with the teachings of the present invention. It is a part of an aircraft wing and comprises an outer contiguous skin 2 having an external face 3 and orthogonally intersecting ribs 4 and 5, respectively, the ribs being integrally formed with the skin 2. Hereinafter, ribs 4 which extend along the panel will be designated "stringers" while the ribs 5 extending orthogonally with respect to the stringers will be called "fins". Skin and ribs are provided by means of milling operations or equivalent machining, rectangular cavities 6 being formed thereby. The dimensions of skin thickness, rib width and height are determined in accordance with the expected load, and all these dimensions may vary at different points along the same panel. The intersections of stringers and fins result in junctions 8, the corners of the cavities 6 at such junctions being rounded as at 9 (cf. FIG. 3).

An apparatus suited to shape such panels will be described below. It is to be noted, however, that this apparatus (and the method associated with it) may also be used for the shaping of panels having stringers only but no fins, or for the shaping of panels comprising a skin part made of sheet material to which ribs are fastened by means of riveting, or by any other means.

Figure 3:
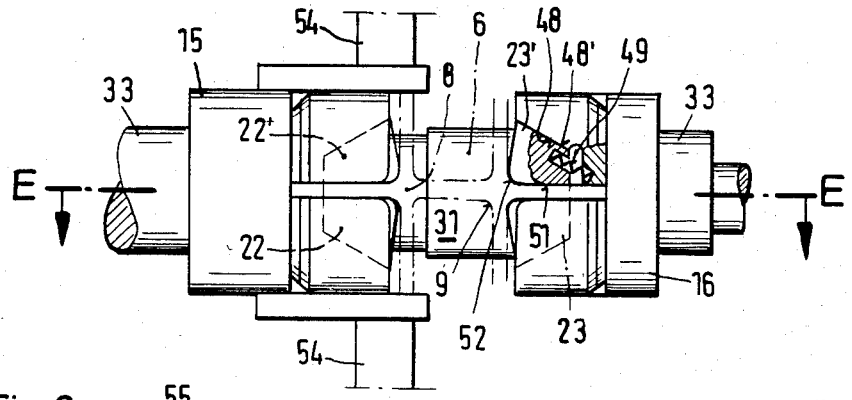
FIG. 3 is a part of a plan view of the apparatus shown in FIG. 2, FIG. 4*a* and 4*b* illustrate, respectively, two positions of the gripping elements when engaging ribs of the panel, the illustration being substantially in the plane indicated IV—IV in FIG. 1.

Turning now to FIGS. 2 and 3, the apparatus designated with reference numeral 10 comprises a bending unit 11 and a hydraulically operated actuator 12. Bending unit 11 comprises a carrier bar 14 supporting two carriers 15 and 16, respectively. Carriers 15 and 16 are mounted on bar 14 such that their relative spacing is adjustable and the adjusted position may be locked. Each carrier has an arm 17 and 18, respectively, extending orthogonally with respect to the axis of bar 14 in plane E′—E′.

The arms provide guide means in a common plane E—E for clamping jaw pairs 22,22′ at arm 17 and 23,23′ at arm 18. Plane E′—E′ extends perpendicularly with respect to plane E—E which extends through bar 14 and arms 17 and 18.

A stop member 31 is disposed on bar 14 between carriers 15 and 16; member 31 may be adjusted in axial position and may be locked by means of set screw 30. Carrier 16 is movably disposed on carrier bar 14 and abuts stop ring 33 screwed on the distal end of bar 14 by means of threads 28 which also enable adjustment of the position of member 31. The other end of bar 14 has an extension 36 which carries the annular piston 40 of hydraulic actuator 12. Piston 40 is received in hydraulic cylinder 41 and defines, together with the cylinder, fluid chamber 42. The piston face 43' and cylinder face 43 are subjected to the pressure of fluid admitted to chamber 42 via inlet and outlet means 42' which may be connected alternatively to a source of pressurized fluid and a reservoir, respectively, by means of appropriate control valves; such valves are readily available on the market and therefore are not illustrated in the drawings.

The free end of piston 40 is threaded onto connecting member 46 by means of threads 44. Member 46, in turn, has screw threads 46' by means of which it is fastened to extension 36 of bar 14. Set screw 45 prevents relative rotation of member 46.

Cylinder 41 abuts axially at carrier 15. Between the latter and stop member 31, axially extending compression springs 32 are disposed, the bias developed by said springs serving to hold carriers 15 and 16 spaced apart when actuator 12 is disconnected from the pressurized fluid source.

Arms 17 and 18 have inclined wedging surfaces 48 engaging counter-surfaces 48' of their respective clamping jaws 22,22',23,23'. Upon the jaws being engaged over a fin, these wedging surfaces act such that the jaws, when pushed against surfaces 48, will securely clamp rib 5. This pushing occurs when the front surfaces of the jaws abut a stringer 4, rounded edge 52 being adapted to the contour of the rounded corners 9 at intersections 4-5. Compression springs 49 bias the jaws into their disengaging position, in which their clamping faces 51 are spaced from rib 5.

The entire apparatus may be handled manually by means of a handle 54.

FIG. 4 illustrates section views according to line IV—IV of FIG. 1, parallel to the plane of one of the stringers 4. Arrows "P" indicate the position of the jaws 22,22'23,23' where they engage stringer 4 and rib 5; spaced apart from the neutral axis $N_F$ of the panel skin by a distance s is the surface center Sp assumed at which the power will be injected. Thus, the engaging surface portions of the jaws are cross-hatched in the drawing. It is to be noted that s (the distance between the arrows P and the center plane of the skin 2) is different in FIGS. 4*a* and 4*b*, and that consequently even with otherwise identical conditions the bending will affect the individual parts of the panel in quite a different manner.

FIG. 5 is a diagram in which the bending stress and crushing stress, respectively, in skin 2 and ribs 5, respectively, are indicated. It is to be noted that, with proper election of the spacing s, only minor tensioning or crushing stresses will be developed in skin 2, or there are even no such stresses at all at least in the neutral axis $N_F$ which is coincident with the skin center plane. The shaping apparatus may be positioned such that this neutral axis will always have the same position with respect to the outer face 3 of skin 2 irrespective of skin thickness variation, with the result that no corrugations will be created on the outer face due to the entire shaping operation.

Figure 6:
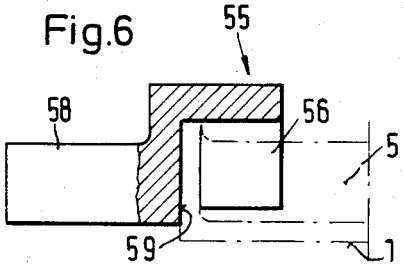
FIG. 6 is a longitudinal section of an auxiliary device to be combined with the apparatus.
Figure 7:
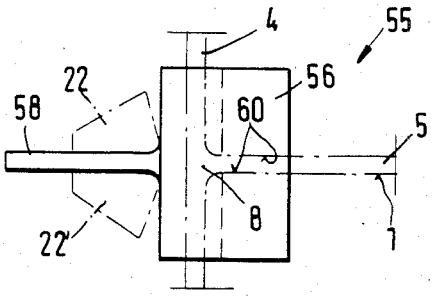
FIG. 7 is a plan view of the device shown in FIG. 6.

FIGS. 6 and 7 illustrate an auxiliary device 55 to be used in case of panels where a fin terminates at a stringer. It is evident that under these circumstances, one pair of jaws cannot clamp a fin. Device 55 engages stringer 4 with a transverse face 59, and it is positioned with respect to the intersection by means of depending portions 56 engaging the lateral rib surfaces 60. At its opposite end, device 55 has a tail portion 58 having the design and size of a rib 5 so that it may be engaged by the respective pair of jaws 22,22' or 23,23'.

The apparatus operates as follows:

At first, the distance between carrier 15 and carrier 16 is adjusted such that their clamping jaws 22,22' and 23,23' engage a rib behind its intersection with stringers, at least two stringers being between the carriers. Further, stop member 31 is axially positioned on bar 14 by means of its screw thread and is locked such that a desired shaping stroke may be executed. The actuator is then fed with pressurized hydraulic fluid into its cylinder chamber 42 so that piston 40 is moved and shortens the distance between carriers 15 and 16. Because of the wedging surfaces 48, 48' the jaws 22, 22', 23, 23' will safely grip the rib 5, and during the piston stroke which is limited by stop member 31 the rib portion between the pairs of jaws will be upset. Upon removal of the pressure in chamber 42, the carriers will be moved apart because of the bias of springs 32, and springs 49 will cause disengagement of the jaws from the lateral surfaces of rib 5.

An expert skilled in the art will easily realize that the device may be modified to shape the panel by means of elongation instead of upsetting.

What we claim is:

1. A method for shaping panels made of a plastically deformable material having both a skin portion and a plurality of intersecting stiffening and secondary ribs on one surface of said skin portion, comprising the steps of transmitting force along said stiffening ribs to plastically vary the length thereof, said force being transmitted to a stiffening rib by engaging the stiffening rib and applying force at the points of intersection between said stiffening and secondary ribs at a predetermined distance spaced outwardly from said skin portion whereby said skin portion is subjected to bending forces without substantial tensioning or crushing stresses being imparted thereto.

2. A method as set forth in claim 1 wherein said predetermined distance is selected such that a neutral axis is at least approximately in the center of said skin portion halfway from said one surface thereof.

3. A method as in claim 1, wherein the stiffening and second ribs intersect one another orthogonally.

4. A method as in claim 1, wherein the force is applied on the opposite sides of a pair of said second ribs.

5. An apparatus for the deformation of sheet metal provided with reinforcing ribs extending perpendicularly from one sheet metal surface thereof and extending in a direction in which a curvature of the sheet is to be made, means to alter the length of said ribs to vary the curvature of said sheet metal comprising:

at least two pairs of clamping jaws adapted to engage respectively one of said ribs at spaced apart points, adjustment means associated with at least one of said pairs of clamping jaws for adjusting the distance by which said points are spaced apart, power drive means for moving said jaw pairs relative to one another, and stop means for limiting said relative movement.

6. An apparatus as set forth in claim 5 wherein a first jaw carrier for a first pair of said clamping jaws is mounted stationarily on a support, a second jaw carrier for a second pair of said clamping jaws is mounted to be movable along said support by said adjustment means and is lockable at a selected position, a stop member providing said stop means is disposed on said support between said first and said second jaw carriers, and a hydraulic ram provides said power drive means and is adapted to alter the length of said support between said carriers by a distance defined by said stop member.

7. An apparatus as set forth in claim 6 wherein said clamping jaws are supported by said jaw carriers via wedging surfaces such that two jaws forming a jaw pair clamp said rib between them when a force acting in a predetermined direction parallel to said rib is exerted upon their respective carriers.

8. An apparatus as set forth in claim 6 wherein said support comprises: a hydraulic ram cylinder on which said first jaw carrier and a counter stop member are mounted, and a piston which is hydraulically displaceable in said cylinder and has a piston rod which carries said second jaw carrier and said stop member.

9. An apparatus as set forth in claim 7 wherein reset spring means are provided biasing said jaw carriers into their initial position upon deactivation of said power drive means.

10. An apparatus as set forth in claim 5 for deforming panels which have first ribs to be engaged by one of said clamping jaw pairs and second ribs intersecting said first ribs orthogonally, wherein said apparatus has an intermediate force transmitting member engageable over one of said second ribs adjacent one of said intersections and provided with a tail portion to be engaged by the other pair of jaws.

* * * * *